US005398777A

United States Patent [19]

Ouellette et al.

[11] Patent Number: 5,398,777

[45] Date of Patent: Mar. 21, 1995

[54] LIFELINE ANCHOR ASSEMBLY FOR PRE-CAST CONCRETE DECK

[75] Inventors: Kevin D. Ouellette, Andover; David S. Denny, Middle Haddam; B. Holt Whatley, East Haddam, all of Conn.

[73] Assignee: SINCO Acquisition Corporation, East Hampton, Conn.

[21] Appl. No.: 972,124

[22] Filed: Nov. 5, 1992 (Under 37 CFR 1.47)

[51] Int. Cl.[6] ..... A62B 35/00

[52] U.S. Cl. ..... 182/3; 248/231.5

[58] Field of Search ..... 182/3, 45, 113; 248/237, 231.5

[56] References Cited

U.S. PATENT DOCUMENTS

| | | | |
|---|---|---|---|
| 4,371,138 | 2/1983 | Roberts | 248/231.5 X |
| 5,011,106 | 4/1991 | Cody | 182/3 X |
| 5,143,171 | 9/1992 | Glynn et al. | 182/3 |

*Primary Examiner*—Alvin C. Chin-Shue

*Attorney, Agent, or Firm*—Chilton, Alix & Van Kirk

[57] ABSTRACT

A lifeline safety system is employed for anchoring a retractable lifeline system to a pre-cast deck panel to provide fall protection for workers. The lifeline anchor assembly employs a pair of clamp bars which are adapted and positionable for engaging opposing lifting notches of the pre-cast panel. The retractable lifeline is received in mounting shoes which are mounted to the top of a frame which extends across the top of the panel.

21 Claims, 4 Drawing Sheets

LIFELINE ANCHOR ASSEMBLY FOR PRE-CAST CONCRETE DECK

BACKGROUND OF THE INVENTION

This invention relates generally to safety systems and devices for ensuring the safety of workers while positioned on a roof or an elevated structure. More particularly, the present invention relates primarily to safety systems and devices for preventing construction workers and the like from accidentally falling from a roof or a structure during the construction process.

Lifelines which may be retractable and various safety rails have been conventionally employed as safety devices in connection with the construction and maintenance of roofs and decks. In conventional safety systems to which the invention relates, lifelines are directly or indirectly securely anchored to a fixed structure and connect with a safety belt or harness worn by the worker. The extendable length of the lifeline is effectively restricted so that an accidental fall or rapid change of position of the worker is prevented by automatically locking the position of the lifeline, or for an auxiliary lifeline, the position of the auxiliary lifeline relative to a principal safety cable. One of the critical problems which is encountered in connection with such safety systems is anchoring the safety device to the roof structure so that the safety device remains effectively anchored should it be subject to severe loading due to an accidental fall or usage in an emergency situation. Providing a suitable anchoring structure is especially troublesome during construction or while the roof structure is only partially installed.

U.S. Pat. No. 5,143,171, which is assigned to the assignee of the present invention, discloses a lifeline system for a pitched roof. The system employs a frame for mounting the lifeline above the peak of the roof. The lifeline is received and secured in a shoe. Shoulders extend from the shoe and engage opposing sides of the pitched roof. Various anchor devices and hardware are disclosed for securing the system to the roof. In one disclosed embodiment, two roof-mounting pods are pivotally mounted to a shoe which receives the retractable lifeline housing.

For some construction projects, it is common for pre-cast concrete decking panels or planks to be lifted and positioned on a framework to form the floors or decks for the structure. Such pre-cast panels typically have widths on the order of 4 feet and thicknesses on the order of 8 inches. Opposed sides of the panel are slightly tapered and are traversed by groove-like channels which function as lifting notches. The panels are typically hollow core members manufactured from reinforced concrete. The panels are grabbed at the notches by self-loading tongs or hooks for lifting the panels into position.

It has long been recognized that fall protection of workers is a particular problem during the installation of pre-cast concrete deck panels because of the difficulty of providing an effective anchoring location for a lifeline. During conventional pre-cast panel construction techniques, it is highly desirable and necessary that the workers essentially be positioned near the leading edge of the deck as the panels are moved into position so that the next panel in sequence may be properly positioned.

SUMMARY OF THE INVENTION

Briefly stated, the invention in a preferred form is an assembly for anchoring a retractable safety lifeline to a pre-cast concrete deck panel of the type which has lifting notches disposed at opposite sides. An anchoring frame, which may comprise a pair of longitudinally extending steel beams, includes opposite first and second ends. A shoe for receiving the retractable lifeline is mounted at the top of the frame members. A removable pin or other means secures the lifeline in the shoe. A clamp assembly is mounted at the first fixed end in a generally fixed relationship with the frame. The clamp assembly includes a bar for engaging a lifting notch of the panel. A second clamp assembly is mounted at the opposite second end of the frame and is generally pivotal therewith. The second clamp assembly also has a bar which is adapted to engage in a lifting notch of the panel. A lock, which in one embodiment is in the form of a ratchet jack, locks the clamp assemblies into clamping engagement against the lifting notches of the concrete panel thereby providing an anchor for the retractable lifeline.

Each of the clamp assemblies in the preferred embodiment employs a plate which mounts a gripping bar dimensioned and positioned for reception by the lifting notches. Handles are also mounted at opposing ends of the frame to facilitate portability of the anchor assembly. Feet are provided at the underside of the frame to provide proper clearance for the anchoring assembly. In one disclosed embodiment, the frame is configured to receive and secure a pair of retractable lifelines.

An object of the invention is to provide a new and improved system for anchoring a lifeline to a pre-cast concrete deck.

Another object of the invention is to provide a new and improved means for providing fall protection for workers while positioning panels at the leading edge of a pre-cast concrete deck.

A further object of the invention is to provide a new and improved lifeline anchor system which continuously implements a secure and temporary anchorage with a pre-cast deck under construction without interfering with the structure or the construction sequence of the pre-cast deck.

Other objects and advantages of the invention will become apparent from the specification and the drawings.

DETAILED DESCRIPTION OF THE PREFERRED EMBODIMENT

Figure 1:
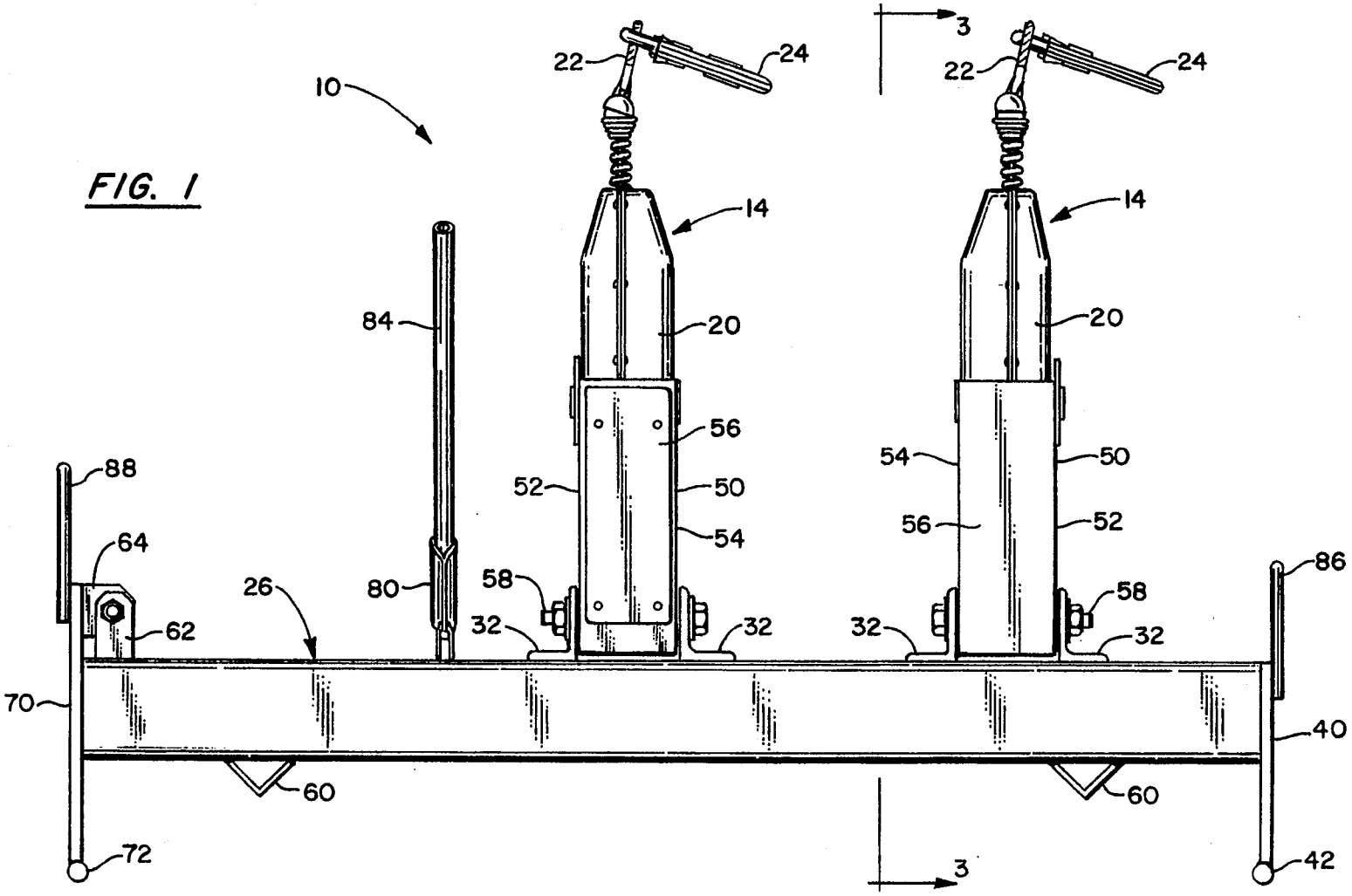
FIG. 1 is a side elevational view of a lifeline anchor assembly in accordance with the present invention.
Figure 2:
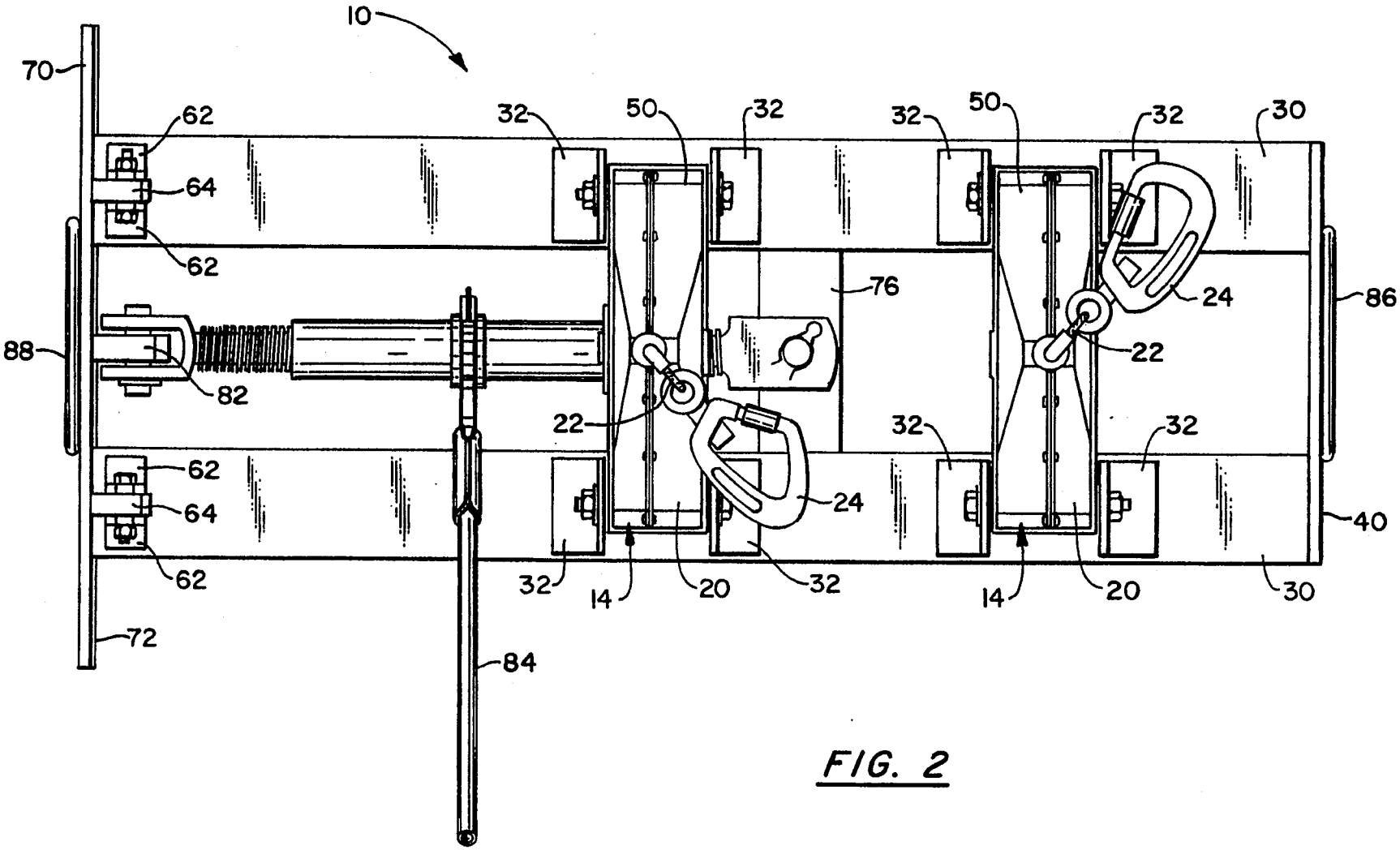
FIG. 2 is a top plan view of the lifeline anchor assembly of FIG. 1.
Figure 3:
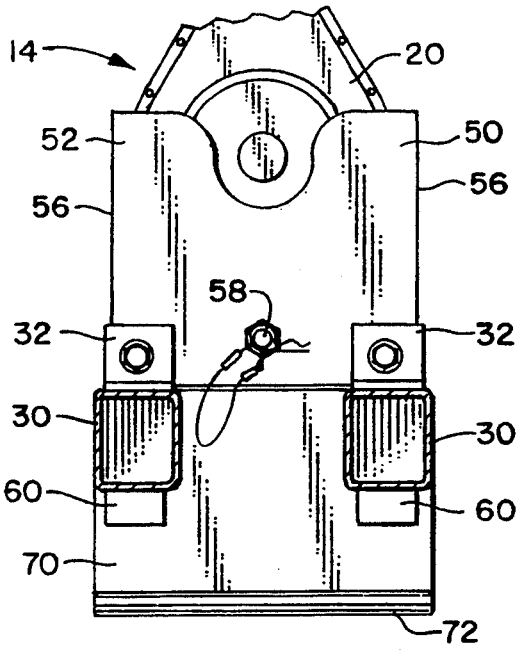
FIG. 3 is a fragmentary sectional view of the lifeline anchor assembly of FIG. 1 taken along the line 3—3 thereof.

With reference to the drawings wherein like numerals represent like parts throughout the several figures, a lifeline anchor assembly in accordance with the present invention is generally designated by the numeral 10. The lifeline anchor assembly 10 is adapted for anchoring to a pre-cast concrete panel 12 (FIG. 4) as will be further described below. The anchor assembly is adapted to receive the casing or housing for a retractable lifeline system designated generally by the numeral 14 to provide fall protection for a construction worker installing such pre-cast panels 12 to form a roof or deck.

In accordance with the preferred application of the invention, a worker preferably wears a safety belt or harness (not illustrated) which connects with the lifeline system 14. The lifeline system 14 may be a conventional lifeline such as the SINCO Model 64 Retract-A-Matic TM lifeline marketed by the assignee of the present invention. The lifeline system 14 includes a steel housing 20 which houses a self-contained 3/16 inch steel cable 22. The cable 22 terminates with a carabiner 24 for connecting the cable with a safety belt or a harness. The cable 22 or lifeline is wound on a reel (not illustrated) within the housing and is extendable and retractable to provide a limited length which is required for working on the deck structure. A centrifugal locking/rewinding assembly automatically prevents accidental falls by locking the cable 22 at an attained length upon rapid acceleration tending to unwind (lengthen) the lifeline cable.

Figure 4:
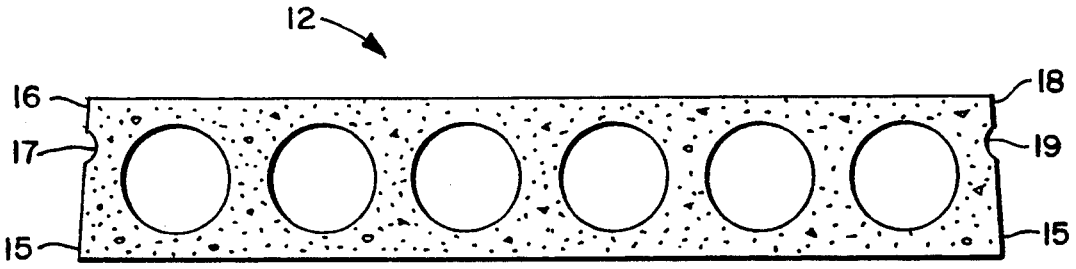
FIG. 4 is an end view of a pre-cast concrete deck panel.
Figure 5:
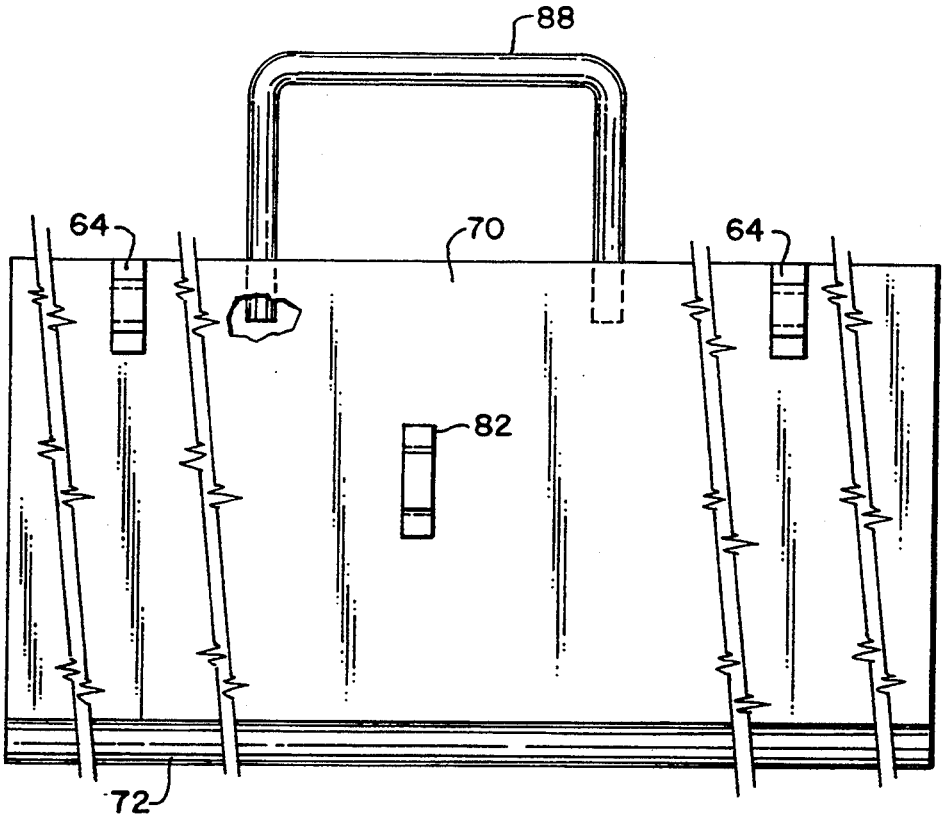
FIG. 5 is an enlarged end view partly broken away and partly in phantom of a sub-assembly for the lifeline anchor assembly of FIG. 1.

The pre-cast concrete decks (not illustrated) for which the invention is particularly adapted are constructed of substantially identical pre-cast panels 12 which are sequentially lifted and positioned in side-by-side relationship onto the framework. With reference to FIG. 4, the panels 12 are typically hollow core members manufactured from reinforced concrete. A typical panel has a width on the order of 4 feet and a thickness on the order of 8 inches and a length of several feet. The sides 16, 18 are typically slightly inwardly tapered toward the top. In addition, the panels are traversed at opposing sides 16, 18 by respective groove-like channels or lifting notches 17, 18. The notches 17, 18 are used for grasping by a self-loading grabber in the form of tongs or hooks for lifting the panels and positioning the panels on the structure. Upon installation, the panels abut along a blunt ridge 15 which longitudinally extends along the lower portions of the sides so as to form a quasi-V-shaped gap which is filled with grout or similar material.

The anchor assembly 10 has a frame 26 which is dimensioned to mount over and span between the panel sides 16, 18. The frame 26 includes a pair of substantially identical and generally parallel steel tubular beams 30 which are connected by an orthogonally oriented fixed plate 40 at one end thereof. Two pairs of opposed L-shaped connectors 32 are welded or bolted to the top of each of the beams 30. Each of the connectors 32 engages and connects with a canister-like shoe 50 which transversely bridges the beams 30.

Each shoe 50 is in an open box-like metal frame which opens upwardly. Each shoe 50 includes opposing front and rear panels 52, 54 and substantially identical end panels 56. Openings (not illustrated) may be formed in the panels to allow for water drainage. The panels extend vertically and cooperatively form an enclosure having a generally rectangular open end 58 at the top thereof. The shoe open end 58 and the shoe panels 52, 54, 56 are dimensioned to closely receive the casing or housing 20 for the retractable lifeline. The lifeline is secured in the shoe by means of a removable lock pin 58 which extends through an opening in the housing 20 and opposing aligned apertures of the panels 52, 54. In the illustrated embodiment, two such shoes 50 and retractable lifelines 14 are illustrated. However, it should be noted that the invention is equally applicable to one or more than two such shoes.

Laterally spaced feet 60 in the form of angle irons are welded at the underside of the frame beams 30. The substantially V-shaped feet 60 are dimensioned and positioned for engaging the top surface of the deck panel 12 to support the frame 26.

Figure 6:
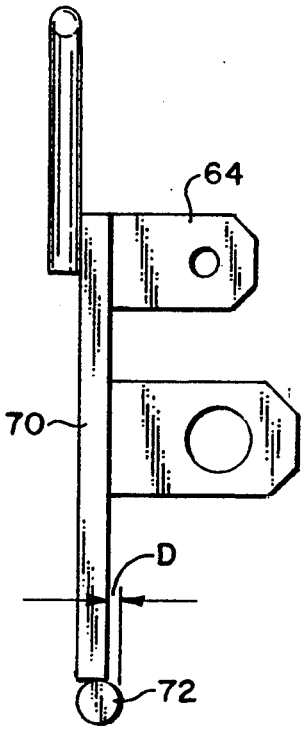
FIG. 6 is a side elevational view of the sub-assembly of FIG. 5.
Figure 7:
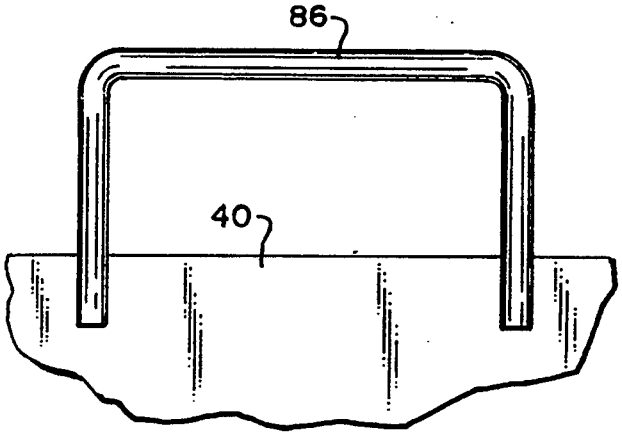
FIG. 7 is an enlarged fragmentary end view of a lifeline anchor assembly of FIG. 1 viewed from the right thereof.

A pair of opposed L-shaped brackets 62 are mounted at the forward end portions of the beams 30. The brackets 62 pivotally mount arms 64 extending perpendicularly from a clamp plate 70. The lower end of the clamp plate 70 mounts a transversely extending bar 72. Bar 72 is a steel bar having a $\frac{3}{4}$ inch diameter and is positioned to be offset a distance D of $\frac{1}{4}$ inch from the plate 70 as illustrated in FIG. 6. The bar 72 is welded to the clamp plate 70 and is positioned and dimensioned for engagement in the lift notch 17 or 19 of the panel 12. The opposing fixed clamp plate 40 also mounts a transverse bar 42 which is offset $\frac{1}{4}$ inch and is dimensioned and positioned for engaging in the opposite lift notch 19 or 17 of the panel. It should be appreciated that the pivotal mounting of the clamp plate 70 allows for the lateral spacing between the engagement bars 42, 72 to vary slightly.

A medial cross member 76 extends transversely between the beams. A ratchet jack 80 such as a mechanical ratcheting jack marketed by McMaster-Carr Supply Company of Brunswick, N.J. is pivotally connected to member 76. The ratchet jack 80 also pivotally connects with a medial link 82 of the clamp plate 70. The jack has a ratchet handle 84 which is ratchetable to fix the position of the pivotal clamp plate 70 and bar 72.

The anchor frame is placed on the top of the panel so that the fixed clamp plate bar 42 engages one of the notches, for example notch 19, and the pivotal clamp bar 72 is positioned adjacent the other notch 17. The frame 26 is vertically supported by the feet 60 which rest on the top of the deck panel 12. The ratchet jack handle 84 is then ratcheted to force the pivotal bar 72 and the fixed bar 42 to forcefully engage into the lift notches 17, 19 so that the frame is essentially clamped to the panel. The lifeline systems 14 may be pre-mounted to the shoes or mounted after the frame is anchored to the panel 12. The cables 22 are connected to a safety belt or harness via the carabiners 24. The bars 42, 72 are dimensioned to allow engagement into the notches 19, 17 and withdrawal therefrom when the panels 12 are positioned in side-by-side abutting relationship. There is a quasi V-shaped gap between the upper portions of the panels due to the tapered sides 16, 18.

Inverted U-shaped handles 86, 88 may be welded to the respective clamp plates 40, 70 to facilitate the portability of the assembly 10.

The anchor assembly may be easily installed in an efficient manner. After two panels of a pre-cast concrete flooring system or deck are installed, the anchor assembly 10 is clamped to the second panel to provide fall protection for workers placing panels at the sequentially progressing leading edge of the deck. The retractable lifelines 22 are connected to the harness or belt worn by the workers. Not only does the anchoring assembly provide a suitable anchor of high load capacity for the lifeline system, but it also provides a means wherein a secure and temporary anchorage can be continuously implemented without affecting the deck structure or the erection sequence of the pre-cast concrete panels. It should be noted that the panels are constructed in a configuration wherein there is a gap at the top of the bottom abutting panels to provide access to the lift notches for both mounting and dismounting the clamp bars 42, 72 from the tapered sides of the pre-cast panels 12.

While the preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An assembly for anchoring a safety lifeline to a pre-cast concrete panel having lifting notches disposed at opposite sides thereof comprising:

frame means for forming a frame having a first end and an opposite second end and defining a longitudinal axis through said first and second ends;

shoe means mounted to said frame means for receiving a lifeline;

securement means for securing said lifeline in said shoe means;

first clamp means mounted to said frame at said first end and comprising a first engagement member extending transversely to said axis substantially the width of said frame means for engaging a lifting notch;

second clamp means mounted to said frame at said second end and comprising a second engagement member extending transversely to said axis substantially the width of said frame means for engaging a second lifting notch; and lock means for locking said first and second clamp means clamped relationship at said notches so that said lifeline is anchored to said panel.

2. The anchoring assembly of claim 1 wherein said second clamp means is pivotally mounted to said frame.

3. The anchoring assembly of claim 2 wherein said lock means comprises a ratchet jack assembly.

4. The anchoring assembly of claim 1 wherein at least one said clamp means comprises a bar.

5. The anchoring assembly of claim 4 wherein said at least one clamp means comprises a plate and said bar is mounted to said plate.

6. The anchoring assembly of claim 5 wherein said plate has an end and said bar is mounted in offset relation to said end.

7. The anchoring assembly of claim 1 wherein said shoe means comprises a box-like container having an open end.

8. The anchoring assembly of claim 1 wherein said securement means comprises a lock pin.

9. The anchoring assembly of claim 1 further comprising a second shoe means mounted to said frame means for receiving a lifeline.

10. An anchoring assembly comprising:

frame means for forming a frame having a top and a bottom and a first end and an opposite second end;

shoe means mounted to the top of said frame means, said shoe means forming a shoe having an upper opening;

first clamp means fixedly mounted to said frame at said first end and comprising a first transverse engagement member;

second clamp means pivotally mounted to said frame at said second end and comprising a second transverse engagement member; and lock means for locking said second engagement member in fixed relationship relative to said first engagement member.

11. The anchoring assembly of claim 10 wherein said lock means is pivotally mounted to said second clamp means.

12. The anchoring assembly of claim 10 wherein said lock means comprises a ratchet jack assembly.

13. The anchoring assembly of claim 10 wherein at least one of said engagement members comprises a bar.

14. The anchoring assembly of claim 13 wherein said second clamp means comprises a plate having a lower end and said bar is mounted to said plate at said lower end.

15. The anchoring assembly of claim 10 further comprising a second shoe means and wherein said each shoe means comprises a box-like container having an open end.

16. The anchoring assembly of claim 10 further comprising laterally spaced feet mounted to the bottom of said frame.

17. An assembly for anchoring a safety lifeline to a pre-cast concrete panel having lifting notches disposed at opposite sides thereof comprising:

frame means for forming a frame having a first end and an opposite second end and defining a longitudinal axis through said first and second ends;

shoe means mounted to said frame means;

lifeline means comprising a retractable lifeline received in said shoe means and secured thereto;

first clamp means mounted to said frame at said first end and comprising a first engagement means extending transversely to said axis substantially the width of said frame means disposed below said frame means for engaging a lifting notch;

second clamp means pivotally mounted to said frame at said second end and comprising a second engagement means extending transversely to said axis substantially the width of said frame means disposed below said frame means for engaging a second lifting notch; and lock means for locking said first and second engagement means in clamped relationship at said notches so that said lifeline is anchored to said panel.

18. The anchoring assembly of claim 17 wherein said lock means comprises a ratchet assembly pivotally connected to said second clamp means.

19. The anchoring assembly of claim 17 wherein said first and second engagement means each comprise a bar.

20. The anchoring assembly of claim 17 further comprising a handle mounted to at least one of said first and second clamp means.

21. An assembly for anchoring a safety lifeline to a pre-cast concrete panel having lifting notches disposed at opposite sides thereof comprising:

frame means for forming a frame having a first end and an opposite second end;

shoe means mounted to said frame means for receiving a lifeline;

securement means for securing said lifeline in said shoe means;

first clamp means mounted to said frame at said first end for engaging a lifting notch;

second clamp means pivotally mounted to said frame at said second end for engaging a second lifting notch; and lock means for locking said first and second clamp means in clamped relationship at said notches so that said lifeline is anchored to said panel; said lock means comprising a ratchet jack assembly.

* * * * *